US005634354A

United States Patent [19]

Howard et al.

[11] Patent Number: 5,634,354

[45] Date of Patent: Jun. 3, 1997

[54] OLEFIN RECOVERY FROM OLEFIN-HYDROGEN MIXTURES

[75] Inventors: Lee J. Howard, Allentown; Howard C. Rowles, Center Valley, both of Pa.

[73] Assignee: Air Products and Chemicals, Inc., Allentown, Pa.

[21] Appl. No.: 646,839

[22] Filed: May 8, 1996

[51] Int. Cl.[6] ..... F25J 1/00

[52] U.S. Cl. ..... 62/624; 62/627; 62/935

[58] Field of Search ..... 62/624, 627, 935; 95/55

[56] References Cited

U.S. PATENT DOCUMENTS

| | | | |
|---|---|---|---|
| 4,002,042 | 1/1977 | Pryor et al. | 62/28 |
| 4,654,047 | 3/1987 | Hopkins et al. | 62/624 |
| 4,654,063 | 3/1987 | Auvil et al. | 62/624 |
| 4,732,583 | 3/1988 | DeLong et al. | 55/16 |
| 4,900,347 | 2/1990 | McCue, Jr. et al. | 62/24 |
| 5,035,732 | 7/1991 | McCue, Jr. | 62/24 |
| 5,053,067 | 10/1991 | Chretien | 62/24 |
| 5,082,481 | 1/1992 | Barchas et al. | 62/23 |
| 5,332,424 | 7/1994 | Rao et al. | 62/935 |
| 5,354,547 | 10/1994 | Rao et al. | 423/650 |
| 5,421,167 | 6/1995 | Verma | 62/24 |
| 5,452,581 | 9/1995 | Dinh et al. | 62/24 |

OTHER PUBLICATIONS

Shelly, S. "Reengineering Ethylene's Cold Train", Chemical Engineering/Jan. 1994, pp. 37–41.

Verma et al., "Revamping Olefins Plant with Membrane Technology, Paper presented at the American Institute of Chemical Engineering spring National Meeting", Apr. 20, 1994, Atlanta, Georgia.

*Primary Examiner*—Ronald C. Capossela

*Attorney, Agent, or Firm*—John M. Fernbacher

[57] ABSTRACT

Olefins are recovered from thermally cracked gas or fluid catalytic cracking off gas by cooling the gas to condense a portion of the hydrocarbons, removing hydrogen from the noncondensed gas, and condensing the remaining hydrocarbons in a cold condensing zone using a dephlegmator which operates above about −166° F. This mode of operation minimizes the amount of methane in the condensate which is further processed in demethanizer column(s) and permits the condensation of ethylene at warmer temperatures than possible using a partial condenser in the cold condensing zone. The use of a dephlegmator at temperatures above about −166° F. minimizes or eliminates the formation and accumulation of unstable nitrogen compounds in the ethylene recovery system. Hydrogen is removed from the noncondensed gas in a process selected from polymeric membrane permeation, adsorptive membrane permeation, or pressure swing adsorption.

22 Claims, 4 Drawing Sheets

OLEFIN RECOVERY FROM OLEFIN-HYDROGEN MIXTURES

TECHNICAL FIELD OF THE INVENTION

The invention relates to the recovery of olefins from mixed gases containing olefins and hydrogen, and in particular to the utilization of non-cryogenic separation systems in conjunction with cryogenic separation methods for ethylene recovery.

BACKGROUND OF THE INVENTION

The recovery of olefins such as ethylene and propylene from gas mixtures is an economically important but highly energy intensive process in the petrochemical industry. These gas mixtures are produced by hydrocarbon pyrolysis in the presence of steam, commonly termed thermal cracking, or can be obtained as offgas from fluid catalytic cracking and fluid coking processes. Cryogenic separation methods are commonly used for recovering these olefins and require large amounts of refrigeration at low temperatures.

Olefins are recovered by condensation and fractionation from feed gas mixtures which contain various concentrations of hydrogen, methane, ethane, ethylene, propane, propylene, and minor amounts of higher hydrocarbons, nitrogen, and other trace components. Methods for condensing and fractionating these olefin-containing feed gas mixtures are well-known in the art. Refrigeration for condensing and fractionation is commonly provided at successively lower temperature levels by ambient cooling water, closed cycle propylene and ethylene systems, and work expansion or Joule-Thomson expansion of pressurized light gases produced in the separation process. Recent improvements in cryogenic olefin recovery methods have reduced energy requirements and increased recovery levels of ethylene and/or propylene.

One improvement to the cryogenic separation section of a conventional ethylene recovery process is described in U.S. Pat. No. 4,002,042 whereby the final feed gas cooling and ethylene condensing step, between about −75° F. and −175° F., is performed in a dephlegmator-type heat exchanger. This provides a much higher degree of prefractionation as the ethylene-containing liquids are condensed out of the cold feed gas, since the dephlegmator can provide 5 to 15 or more stages of separation, as compared to the single stage of separation provided by a partial condenser. As a result, significantly less methane is condensed from the feed gas and sent to the demethanizer column and refrigeration energy requirements for both feed cooling and demethanizer column refluxing are reduced. The multi-stage dephlegmator also condenses the ethylene at warmer temperatures than the single-stage partial condenser, which provides additional savings in refrigeration energy.

Further improvements to the cryogenic separation and cold fractionation sections of the conventional process are described in U.S. Pat. Nos. 4,900,347 and 5,035,732. Feed gas cooling for ethylene recovery below about −30° F. is done in a series of at least two dephlegmators, for example, a warm dephlegmator and a cold dephlegmator, and the demethanizer column is split into a first (warm) demethanizer column and a second (cold) demethanizer column. The warm dephlegmator condenses and prefractionates essentially all of the propylene and heavier hydrocarbons remaining in the −30° F. feed gas along with most of the ethane and this liquid is sent to the warm demethanizer column. Reflux for the warm demethanizer column typically is provided by condensing a portion of the overhead vapor against propylene or propane refrigeration at −40° F. or above. The cold dephlegmator condenses and prefractionates the remaining ethylene and ethane in the cold feed gas and this liquid is sent to the cold demethanizer column. Reflux for the cold demethanizer column is typically provided by condensing a portion of the overhead vapor using ethylene refrigeration at about −150° F.

U.S. Pat. No. 5,082,481 discloses a variation of the conventional process whereby a portion of the hydrogen to be used as fuel, for example 20%, is removed from the cracked gas feed at near ambient temperature prior to cooling. This allows the condensation and separation of the hydrocarbons to be carried out at higher temperatures, with a corresponding reduction in refrigeration energy requirements. Hydrogen product is produced by means of a low temperature hydrogen recovery system.

A process is described in U.S. Pat. No. 4,732,583 in which a hydrogen-containing stream is separated in a membrane separator into a high purity hydrogen stream and a low purity hydrogen stream prior to processing the low purity hydrogen stream in a cryogenic separation unit to produce a second high purity hydrogen stream without depressurization. This process relates to the cryogenic purification of hydrogen at high pressures, near the critical pressure of the hydrogen-containing stream.

U.S. Pat. No. 5,053,067 discloses a similar process whereby a portion of the hydrogen in a refinery offgas is removed prior to fractionation such that the overhead condenser of the fractionation column can be operated at a temperature of −40° F. or warmer to utilize high level refrigeration (e.g., propylene refrigeration). This process relates to the recovery of $C_3$ or heavier hydrocarbon components from refinery offgas.

Nitric oxide (NO) is present in olefin-containing feed gas obtained from fluid catalytic cracking and fluid coking processes, and may be present in cracked gas obtained by thermal cracking. NO can enter the cryogenic section of an olefin recovery plant and cause the formation and buildup of unstable nitrogen compounds such as nitrosogums and ammonium nitrite. Such accumulated nitrogen compounds can react explosively at certain conditions and severely damage process equipment. These compounds can accumulate in the low pressure methane vaporization circuit(s) of the low temperature hydrogen recovery system heat exchangers and the demethanizer column feed liquid rewarming circuit(s) in the cold ethylene recovery partial condensers. These circuits contain liquid streams which are introduced at temperatures below −166° F. (−110° C.) which is believed to be the critical upper temperature limit for the formation of these unstable nitrogen compounds. This safety problem is discussed in an article by S. Shelly entitled "Reengineering Ethylene's Cold Train" in Chemical Engineering, January 1994, pages 37–41.

The development of new processing options, particularly in the initial gas cooling and condensation steps prior to final distillation, is desirable to improve the efficiency of olefin recovery systems. In particular, it is beneficial to reduce the amount of hydrogen in the feed to the lower temperature processing steps operating below −100° F. and especially below −150° F. This, in turn, reduces refrigeration at the lowest temperature levels required for high ethylene recovery. In addition, it is desirable to operate at conditions which minimize or eliminate the formation and accumulation of unstable nitrogen compounds in the olefin recovery system. The invention described in the following specification and defined in the appended claims addresses these needs and provides an improved method for the initial cooling and condensation of olefin-containing feed gas prior to low temperature fractionation.

SUMMARY OF THE INVENTION

The invention is a method for the recovery of olefins from a feed gas containing olefins and hydrogen which comprises cooling and partially condensing the feed gas in a first condensing zone to yield a first vapor enriched in hydrogen and a first liquid enriched in olefins, optionally warming the first vapor, introducing the first vapor into a hydrogen-olefin separation process, withdrawing therefrom a hydrogen-enriched stream and an olefin-enriched intermediate stream, and introducing the olefin-enriched intermediate stream into a second condensing zone wherein the olefin-enriched intermediate stream is further cooled, partially condensed, and rectified in a dephlegmator. A second liquid further enriched in olefins and a second vapor depleted in olefins are withdrawn from the dephlegmator. The first condensing zone comprises a partial condenser or a dephlegmator.

When the feed gas contains nitric oxide, the temperature at any point in the second condensing zone is maintained above about −166° F. The feed gas comprises cracked gas from the pyrolysis of hydrocarbons in the presence of steam, fluid catalytic cracking offgas, or fluid coker offgas. The olefins contained in the feed gas comprise at least ethylene.

The hydrogen-olefin separation process comprises a polymeric membrane permeation process, a porous adsorptive membrane permeation process, or a pressure swing adsorption process. In the polymeric membrane permeation process, the first vapor is separated into a hydrogen-enriched permeate and an olefin-enriched nonpermeate. In the porous adsorptive membrane permeation process, the first vapor is separated into a hydrogen-enriched nonpermeate and an olefin-enriched permeate. In the pressure swing adsorption process, the first vapor is separated into a hydrogen-enriched nonadsorbed product gas and an olefin-enriched desorbed product gas The olefin-enriched intermediate stream optionally is cooled prior to introduction into the second condensing zone. Cooling of the olefin-enriched intermediate stream is achieved at least in part by indirect heat exchange with the first vapor from the first condensing zone. Optionally, the cooling of the olefin-enriched intermediate stream is achieved at least in part by work expansion prior to the second condensing zone.

In one embodiment of the invention, the polymeric membrane permeation process comprises two polymeric membrane permeator stages in series in which the first vapor is introduced into a first polymeric membrane permeator stage, a first hydrogen-enriched permeate stream and a first olefin-enriched nonpermeate stream are withdrawn therefrom, and the first olefin-enriched nonpermeate stream provides the olefin-enriched intermediate stream to the second condensing zone. The first hydrogen-enriched permeate stream is introduced into a second polymeric membrane permeator stage, and a second hydrogen-enriched permeate stream and a second olefin-enriched nonpermeate stream are withdrawn therefrom. Optionally, some or all of the second olefin-enriched nonpermeate stream from the second polymeric membrane permeator stage is combined with the first olefin-enriched nonpermeate stream from the first polymeric membrane permeator stage.

In another embodiment of the invention, the porous adsorptive membrane permeation process comprises two adsorptive membrane permeator stages in series in which the first vapor is introduced into a first adsorptive membrane permeator stage, a first hydrogen-enriched nonpermeate stream and a first olefin-enriched permeate stream are withdrawn therefrom, and the first olefin-enriched permeate stream provides the olefin-enriched intermediate stream to the second condensing zone. The first hydrogen-enriched nonpermeate stream is introduced into a second adsorptive membrane permeator stage, and a second hydrogen-enriched nonpermeate stream and a second olefin-enriched permeate stream are withdrawn therefrom. Optionally, some or all of the second olefin-enriched permeate stream from the second adsorptive membrane permeator stage is combined with the first olefin-enriched permeate stream from the first adsorptive membrane permeator stage.

In a further embodiment of the invention, the hydrogen-olefin separation process comprises introducing the first vapor into the feed side of a membrane separation zone containing an adsorptive membrane which divides the zone into the feed side and a permeate side, withdrawing a hydrogen-enriched nonpermeate therefrom, introducing the hydrogen-enriched nonpermeate into a pressure swing adsorption process and withdrawing therefrom a nonadsorbed product gas further enriched in hydrogen and an olefin-enriched desorbed gas, sweeping the permeate side of the membrane separation zone with the olefin-enriched desorbed gas, and withdrawing therefrom a combined olefin-enriched permeate-sweep gas mixture which provides the olefin-enriched intermediate stream to the second condensing zone.

The feed gas is cooled in the first condensing zone to condense at least 50% and preferably at least 75% of the ethylene in the feed gas before hydrogen is removed. At least 50% and preferably at least 75% of the hydrogen in the feed gas is removed in the hydrogen-olefin separation process.

By maintaining the lowest temperature in the second condensing zone above about −166° F., the formation and accumulation of unstable nitrogen compounds is minimized or eliminated. This is made possible by the use of a dephlegmator rather than a partial condenser for the second condensing zone. In addition, the use of a dephlegmator in this service minimizes the amount of methane in the ethylene-rich liquid sent to the demethanizer column because the ethylene is condensed at warmer temperatures and partially fractionated in the dephlegmator. This reduces the size of the demethanizer column and/or the amount of refrigeration required in the demethanizer. The use of a dephlegmator instead of a partial condenser thus provides refrigeration savings in addition to controlling the formation and accumulation of unstable nitrogen compounds.

DETAILED DESCRIPTION OF THE INVENTION

Figure 1:
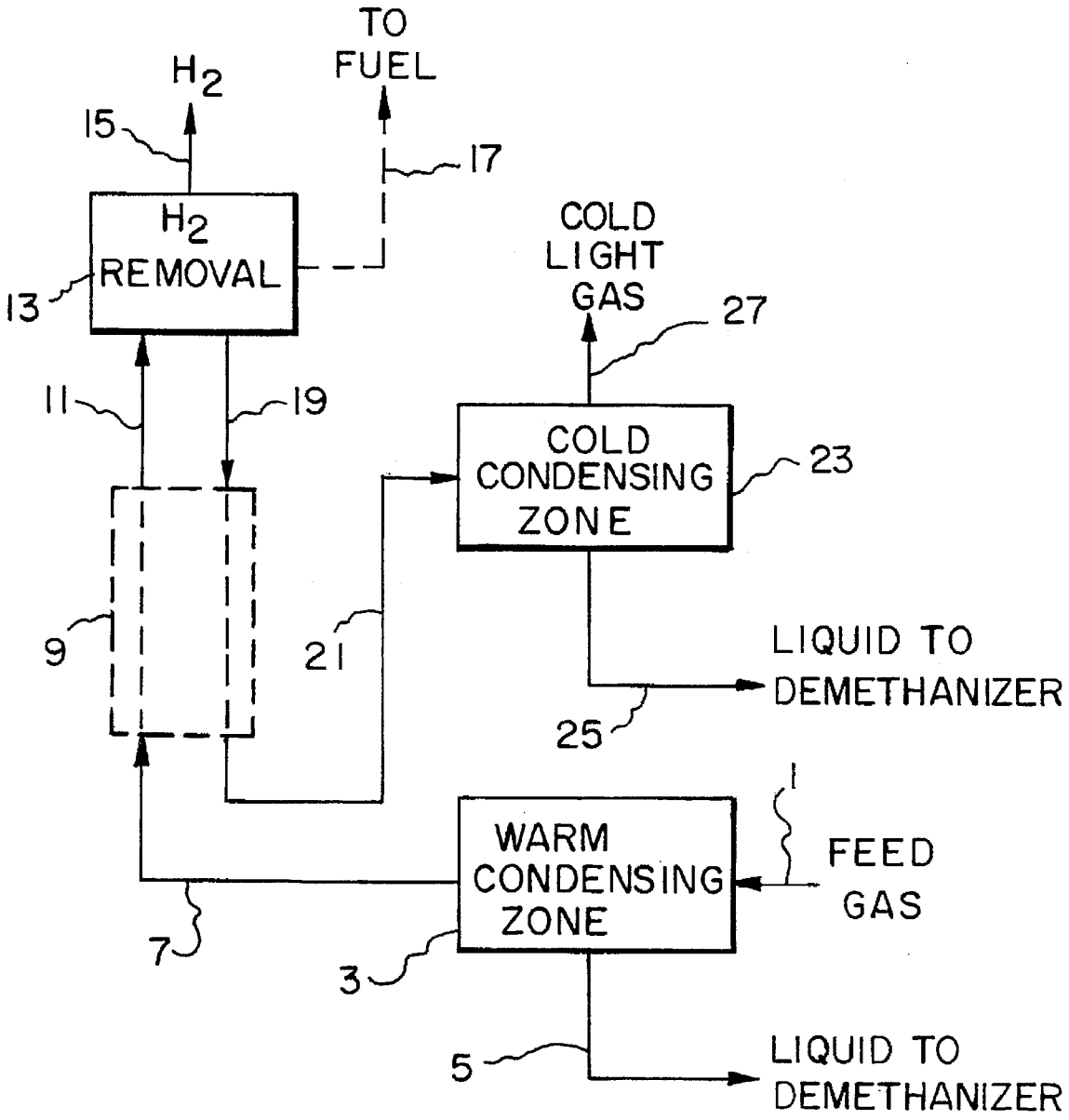
FIG. 1 is a schematic flow diagram for the general embodiment of the process of the present invention.

In most ethylene plants, propylene or propane high level refrigerant is used at several temperature levels, typically between +60° F. and −40° F., to cool the feed gas to about −30° F. and condense most of the propylene, propane, and heavier hydrocarbons from the feed gas. In the cryogenic separation section (or chilling train) of conventional ethylene plants, ethylene low level refrigerant is used at several temperature levels, typically between −70° F. and −150° F., to cool the cracked gas feed to about −145° F. to condense the bulk of the ethylene and ethane from the feed. Colder refrigeration typically is provided by fuel gas expanders or methane recycle loops to cool the feed gas to −190° F. to −220° F. for residual ethylene and ethane recovery. Refrigeration also is recovered from cold process streams, such as hydrogen and fuel (methane-rich) streams, and by rewarming the cold condensed liquid feed streams to the demethanizer column. Each of the cooling/condensing steps is performed in a partial condenser-type heat exchanger.

All of the condensed liquids are sent to a demethanizer column in the cold fractionation section of the plant where hydrogen, methane and other light gases are rejected in the overhead of that column. Reflux for the demethanizer column is typically provided by condensing a portion of the overhead vapor stream using ethylene refrigeration at about −150° F. Typically a significant portion of the hydrogen-methane stream from the overhead of the final ethylene recovery heat exchanger is sent to a low temperature hydrogen recovery system for further cooling (to about −230° F. to −270° F.) and partial condensation to produce a hydrogen vapor product stream and one or more methane-rich liquid streams. The hydrogen-methane stream from the overhead of the demethanizer column and the remaining portion of the hydrogen-methane stream from the overhead of the final ethylene recovery heat exchanger typically are work-expanded in one or more expanders to provide refrigeration below −150° F. in the cryogenic separation section of the process. Any methane which is condensed and separated from the hydrogen vapor product in the hydrogen recovery system is reduced in pressure via Joule-Thomson (isenthalpic) expansion and revaporized to provide refrigeration for the hydrogen recovery heat exchangers. This methane is also warmed in the ethylene recovery heat exchangers for refrigeration recovery but is not available for work expansion, which provides significantly more refrigeration than Joule-Thomson expansion.

Modern ethylene plants are designed for very high levels of ethylene recovery, typically above 99.5%. To attain these high ethylene recoveries, feed gas typically must be cooled to −190° F. to −220° F. in ethylene plants utilizing conventional partial condensation type heat exchangers or to −170° F. to −190° F. in ethylene plants utilizing dephlegmator type heat exchangers. The amount of refrigeration below −150° F. available from process streams in the ethylene plant for feed cooling is limited by operating constraints such as the amount of high pressure hydrogen recovered in the low temperature hydrogen recovery system and the fuel system pressure. These constraints limit the amount of low level expander refrigeration which can be produced, which in turn limits the ethylene recovery.

Refrigeration at temperature levels below −100° F. and particularly at temperature levels below −150° F. is highly energy intensive. The present invention allows the removal of a large portion of the hydrogen after cooling the feed gas to about −100° F. so that the partial pressure of the remaining ethylene in the feed gas is substantially increased. As a result, the remaining ethylene can be condensed from the feed gas at higher temperature levels between about −125° F. and about −160° F., which reduces the amount of low level refrigeration required and the corresponding amount of refrigeration energy required. In addition, because the low temperature hydrogen recovery system is eliminated, none of the methane is reduced in pressure via Joule-Thomson expansion and essentially all of the methane in the feed gas therefore is available for work expansion. The amount of valuable low temperature refrigeration produced by work expansion typically can be increased by 50% or more. In addition, operating the final condensation step above about −166° F. and preferably above about −160° F. minimizes the formation and accumulation of unstable nitrogen compounds in the olefin recovery system.

The general embodiment of the present invention is illustrated in the schematic flowsheet of FIG. 1. Feed gas 1 is a typical cracked gas, fluid catalytic cracker offgas, or fluid coker offgas containing predominantly hydrogen, methane, ethane, and ethylene, with minor amounts of propane, propylene, and heavier hydrocarbons. Typically the gas also contains nitric oxide in the approximate range of 0.001 to 10 ppmv. The gas, which is at a pressure between about 150 and 650 psia and has been precooled against a propylene refrigerant (not shown) to about −20° F. to −40° F. to condense most of the propylene and heavier hydrocarbons, is cooled further in first or warm condensing zone 3 to about −75° F. to −125° F. to condense the bulk of the ethylene and ethane in the feed gas. First liquid condensate 5, enriched in ethylene and ethane, is passed to a demethanizer column for further purification. Refrigeration is provided by ethylene or other refrigerant stream and optionally by one or more cold process streams (not shown). Uncondensed first vapor 7, which is enriched in hydrogen and methane, is withdrawn at between about −75° F. and −125° F.

Warm condensing zone 3 can be a dephlegmator-type heat exchanger, which is a rectifying heat exchanger which partially condenses and rectifies the feed gas as condensed liquid flows downward in contact with upward-flowing vapor. A dephlegmator yields a degree of separation equivalent to multiple separation stages, typically 5 to 15 stages. Alternatively, cooling and condensation of the feed gas in warm condensing zone 3 is accomplished in a conventional condenser, defined specifically herein as a partial condenser, in which a feed gas is cooled and partially condensed to yield a vapor-liquid mixture which is separated into vapor and liquid streams in a simple separator vessel. A single stage of separation is realized in a partial condenser.

Uncondensed first vapor 7 optionally is warmed in heat exchanger 9, and vapor stream 11 is introduced into hydrogen removal or hydrogen-olefin separation system 13 which recovers enriched hydrogen product 15, optionally a reject stream 17 used for fuel, and hydrogen-depleted stream 19 which is enriched in methane, ethylene, and ethane.

Stream 19 optionally is cooled against warming stream 7 in heat exchanger 9, and stream 21 is further condensed in second or cold condensing zone 23 to yield second condensate 25 which is sent to a demethanizer column (not shown) for further purification, and cold light gas 27 which provides additional refrigeration elsewhere in the process. Cold condensing zone 23 is a dephlegmator whose operating temperature is carefully controlled above a minimum of about −166° F. and preferably above about −160° F. in order to minimize or eliminate the formation and accumulation of unstable nitrogen compounds as earlier described.

The preferred use of a dephlegmator in cold condensing zone 23 instead of a partial condenser minimizes the amount of methane in ethylene-rich second liquid 25 sent to the demethanizer column because the ethylene is condensed at warmer temperatures and is partially fractionated in the dephlegmator. This in turn reduces the size of the demethanizer column and/or the amount of refrigeration required in the demethanizer. The use of a dephlegmator instead of a partial condenser in this service thus provides refrigeration savings in addition to controlling the formation and accumulation of unstable nitrogen compounds, because a partial condenser must operate at a temperature of about −190° F. to −220° F. in order to obtain sufficient ethylene recovery. Ethylene-rich second condensate 25, if recovered in a partial condenser rather than a dephlegmator in cold condensing zone 23, is usually rewarmed for refrigeration recovery before being sent to the demethanizer column. This liquid rewarming circuit is susceptible to buildup of unstable nitrogen compounds. By utilizing a dephlegmator in cold condensing zone 23 according to the present invention, liquid 25 is recovered above about −166° F., and preferably above about −160° F., which is safely above the critical temperature for the buildup of unstable nitrogen compounds earlier described.

Hydrogen removal system 13 can utilize any available separation process, and preferably a noncryogenic separation process, to concentrate the desired product ethylene in stream 19. This process can be selected from polymeric membrane permeation, porous adsorptive membrane permeation, or pressure swing adsorption, or combinations of these processes. The specific process is selected based on factors such as the hydrogen concentration in first vapor stream 7, the required recovery and purity of hydrogen stream 15, the desired pressure of hydrogen stream 15 relative to ethylene-enriched stream 19, and the relative value of hydrogen and ethylene.

Figure 2:
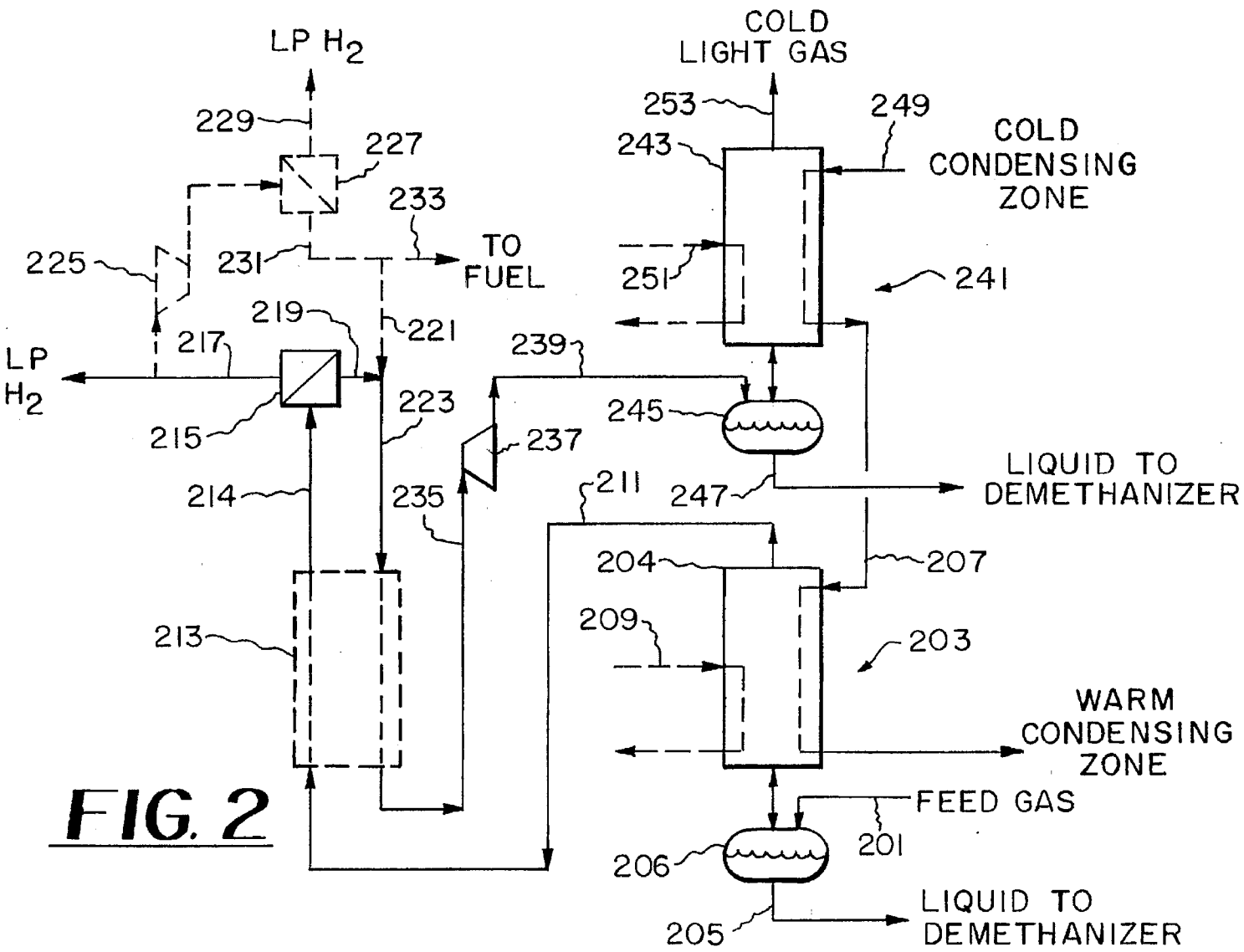
FIG. 2 is a schematic flow diagram for an embodiment of the present invention which utilizes a polymeric membrane permeation process for hydrogen-olefin separation prior to final cryogenic separation.

A specific embodiment of the invention which uses a polymeric membrane process for hydrogen-olefin separation is shown in FIG. 2. Feed gas 201 is a typical cracked gas, fluid catalytic cracker offgas, or fluid coker offgas containing predominantly hydrogen, methane, ethane, and ethylene, with minor amounts of propane, propylene, and heavier hydrocarbons. Typically the gas also contains nitric oxide in the approximate range of 0.001 to 10 ppmv. The gas, which is at a pressure between about 150 and 650 psia and has been precooled against a propylene refrigerant (not shown) to about −20° F. to −40° F. to condense most of the propylene and heavier hydrocarbons, is cooled further in first or warm condensing zone 203 to about −75° F. to −125° F. to condense the bulk of the ethylene and ethane in the feed gas. First condensate 205, enriched in ethylene and ethane, is passed to a demethanizer column for further purification and recovery of ethylene product. Uncondensed first vapor 211 (equivalent to first vapor stream 7 in FIG. 1), which is enriched in hydrogen and methane, is withdrawn at between about −75° F. and −125° F.

Warm condensing zone 203 can be a dephlegmator-type heat exchanger as shown comprising rectifying heat exchanger 204, which partially condenses and rectifies the feed gas as condensed liquid flows downward in contact with upward-flowing vapor, and vapor-liquid separator 206. A dephlegmator yields a degree of separation equivalent to multiple separation stages, typically 5 to 15 stages. Refrigeration is provided by cold process stream 207 at an appropriate temperature, which is shown in FIG. 2 as provided from cold condensing zone 241 (later described). Optionally, additional refrigeration is provided by ethylene or other refrigerant stream 209 obtained from an external refrigeration system (not shown). Alternatively, cooling and condensation of the feed gas in warm condensing zone 203 is accomplished in a conventional condenser (not shown), defined specifically herein as a partial condenser, in which the feed gas is cooled and partially condensed to yield a vapor-liquid mixture which is separated into vapor and liquid streams in a simple separator vessel. A single stage of separation is realized in a partial condenser.

Uncondensed first vapor 211 optionally is warmed in heat exchanger 213, and vapor 214 (at about ambient temperature if warmed) is introduced into polymeric membrane separator 215 which contains assemblies of permeable polymeric membranes which selectively permeate hydrogen and selectively reject other components. Membrane separator 215 may operate at or below ambient temperature. Permeate 217, enriched to 80 to 98 mole % hydrogen, is withdrawn at a reduced pressure of 25 to 150 psia for other uses. Nonpermeate 219, enriched in methane, ethylene, and ethane, is withdrawn at a pressure slightly below that of membrane feed 214. Polymeric membrane separator 215 is any one of the many commercially-available membrane separators known in the art for recovering hydrogen from hydrogen-hydrocarbon mixtures. Such membrane separators are sold for example by Permea, Inc. of St. Louis, Mo. Nonpermeate stream 219 optionally is combined with process stream 221 (defined below) and the combined stream 223 is cooled if necessary against vapor 211 in heat exchanger 213 to a temperature between about −75° F. and −125° F., which is near or slightly above the dew point of cooled vapor stream 235.

In an alternative embodiment, hydrogen-enriched permeate 217 is compressed to 250 to 600 psia in compressor 225 and introduced into second stage membrane separator 227 (similar to membrane separator 215) for further hydrogen purification. High purity hydrogen product 229 is withdrawn at a purity of 90 to 98 mole %. If the ethylene content of nonpermeate 231 is low, it is withdrawn for fuel 233. If the ethylene content of nonpermeate 231 is above about 1–2 mole %, it may be combined with nonpermeate 219 as stream 223 for further cooling and processing as described above.

In another alternative embodiment (not shown), nonpermeate 219 is introduced into a second stage membrane separator to remove residual hydrogen as a second permeate stream and yield a final nonpermeate containing a higher concentration of ethylene for further cooling and processing as described above. The use of this alternative embodiment rather than the embodiment described above with reference to FIG. 2 will depend on the relative concentration of hydrogen in nonpermeate 219 and the particular hydrogen recovery requirements for a given process operation.

Nonpermeate 235 optionally is work expanded in expander 237 and the resulting further cooled, reduced-pressure stream 239 passes into second or cold condensing zone 241 which is a dephlegmator comprising refluxing heat exchanger 243 and vapor-liquid separator 245. Further cooling, condensation, and rectification occurs, and ethylene-rich second liquid 247 is withdrawn therefrom at a temperature of −80° F. to −130° F. and introduced into a demethanizer column (not shown) for further purification. Methane-rich cold overhead vapor 253 is withdrawn and may be combined with the light gas stream from the overhead of the demethanizer column and work expanded (not shown) preferably to provide refrigerant stream 249 for dephlegmator 243. Additional refrigeration is provided if required by ethylene or other refrigerant stream 251 obtained from an external refrigeration system (not shown). The operating temperature of cold condensing zone 241 is carefully controlled above a minimum of about −166° F. and preferably above about −160° F. in order to minimize or eliminate the formation and accumulation of unstable nitrogen compounds as earlier described.

The preferred use of a dephlegmator in cold condensing zone 241 instead of a partial condenser minimizes the amount of methane in ethylene-rich second liquid 247 sent to the demethanizer column because the ethylene is condensed at warmer temperatures and partially fractionated in the dephlegmator. This in turn reduces the size of the demethanizer column and/or the amount of refrigeration required in the demethanizer. The use of a dephlegmator instead of a partial condenser thus provides refrigeration savings in addition to controlling the formation and accumulation of unstable nitrogen compounds, because a partial condenser must operate at a temperature of about −190° F. to −220° F. in order to obtain sufficient ethylene recovery. Ethylene-rich condensate 247, if recovered in a partial condenser rather than a dephlegmator, is usually rewarmed for refrigeration recovery before being sent to the demethanizer column. This liquid rewarming circuit is susceptible to buildup of unstable nitrogen compounds. By utilizing a dephlegmator in cold condensing zone 241 according to the present invention, liquid 247 is recovered above about −166° F., and preferably above about −160° F., which is safely above the critical temperature for the buildup of unstable nitrogen compounds earlier described.

Figure 3:
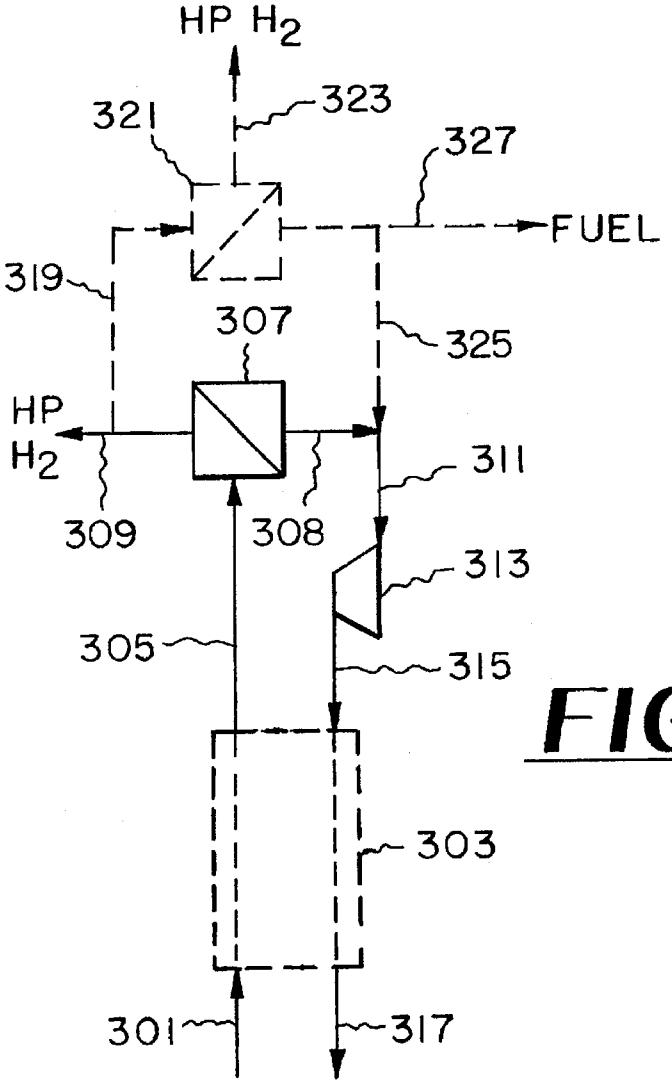
FIG. 3 is a schematic flow diagram for an embodiment of the present invention which utilizes a porous adsorptive membrane permeation process for hydrogen-olefin separation prior to final cryogenic separation.

An alternative embodiment for separating hydrogen from uncondensed vapor from the warm condensing zone is shown in FIG. 3. Uncondensed first vapor 301 (equivalent to uncondensed first vapor streams 7 of FIG. 1 and 211 of FIG. 2), at a temperature between about −75° F. and −125° F. and a pressure of 150 to 650 psia, optionally is warmed in a similar manner in heat exchanger 303 against cooling stream 315 (later defined) to yield warmed stream 305 at ambient or slightly below ambient temperature. This stream is introduced into adsorbent membrane separator 307, and the hydrocarbons preferentially adsorb and permeate through the membrane. Permeate 308 is thereby enriched in hydrocarbons including ethylene and is withdrawn from the permeate side of the separator at a reduced pressure up to about 25 psia and optionally up to 150 psia. Nonpermeate stream 309 is thereby enriched in hydrogen and is withdrawn from the feed side of the separator at near the membrane feed pressure.

Membrane zone 307 is separated into the feed side and permeate side by an adsorbent membrane which comprises adsorbent material supported by a porous substrate in which the adsorbent material is a coating on the surface of the substrate. Alternatively, some or all of the adsorbent material is contained within the pores of the substrate. The adsorbent material typically is selected from activated carbon, zeolite, activated alumina, silica, or combinations thereof. The characteristics and methods of preparation of adsorbent membranes are described in U.S. Pat. No. 5,104,425 which is incorporated herein by reference. A preferred type of membrane for use in the present invention is made by coating a porous graphite substrate with a thin film of an aqueous suspension (latex) containing a polyvinylidine chloride polymer, drying the coated substrate at 150° C. for five minutes, heating the substrate in nitrogen to 600°–1000° C. at a rate of 1° C. per minute, holding at temperature for three hours, and cooling to ambient temperature at 1°–10° C. per minute. The polymer coating is carbonized during the heating step thereby forming an ultrathin layer of microporous carbon on the substrate. Other polymers can be used for coating prior to the carbonization step provided that these polymers can be carbonized to form the required porous carbon adsorbent material. Such alternate polymers can be selected from polyvinyl chloride, polyacrylonitrile, styrene-divinylbenzene copolymer, and mixtures thereof.

The adsorbent membrane and substrate can be fabricated in a tubular configuration in which the microporous adsorbent material is deposited on the inner and/or outer surface of a tubular porous substrate, and the resulting tubular adsorbent membrane elements can be assembled in a shell-and-tube configuration in an appropriate pressure vessel to form a membrane module. Alternatively, the adsorbent membrane and support can be fabricated in a flat sheet configuration which can be assembled into a module using a plate-and-frame arrangement. Alternatively, the adsorbent membrane and support can be fabricated in a monolith or multichannel configuration to provide a high membrane surface area per unit volume of membrane module. The monolith can be a porous ceramic, porous glass, porous metal, or a porous carbon material. A hollow fiber configuration may be used in which the adsorbent membrane is supported by fine hollow fibers of the substrate material. A plurality of membrane modules in parallel and/or series can be utilized when gas feed rates and separation requirements exceed the capability of a single module of practical size.

Hydrocarbon-enriched permeate 308 optionally is combined with process stream 325 (later defined), the combined stream 311 is compressed to 150 to 650 psia in compressor 313, compressed stream 315 optionally is cooled in exchanger 303 against warming stream 301 to yield hydrocarbon stream 317, and this stream is further cooled and condensed in cold condensing zone 241 as described for stream 21 with reference to FIG. 1. In an optional mode of operation, some or all of hydrogen-enriched nonpermeate 309 is introduced as stream 319 into second stage adsorbent membrane separator 321 for the additional recovery of high pressure hydrogen stream 323 and further enriched hydrocarbon permeate 325, which optionally is combined with permeate 308 as described above. Stream 319 may be compressed if desired prior to second stage adsorbent membrane separator 321. The optional use of a second stage separator allows increased recovery of ethylene and a higher concentration of hydrogen in hydrogen-enriched product 323. A portion 327 of permeate 325 may be withdrawn as fuel if desired.

The operation of single stage adsorbent membrane separator 307 recovers a major fraction of the ethylene in feed stream 305. Hydrogen-enriched nonpermeate stream 309 is of moderate purity which depends upon the composition of feed 305. The use of second stage separator 307 modestly increases the purity of hydrogen nonpermeate stream 323, and would be used chiefly to increase ethylene recovery.

In contrast with the operation of the polymeric membrane separation process of FIG. 2, in which hydrocarbon-enriched nonpermeate stream 219 is obtained at a pressure slightly below the membrane feed pressure and hydrogen-enriched permeate stream 217 is obtained at a much lower pressure, the adsorptive membrane process of FIG. 3 operates such that hydrogen-enriched stream 309 is obtained as a nonpermeate at a pressure only slightly below the membrane feed pressure and hydrocarbon-enriched stream 308 is obtained at a much lower pressure.

Figure 4:
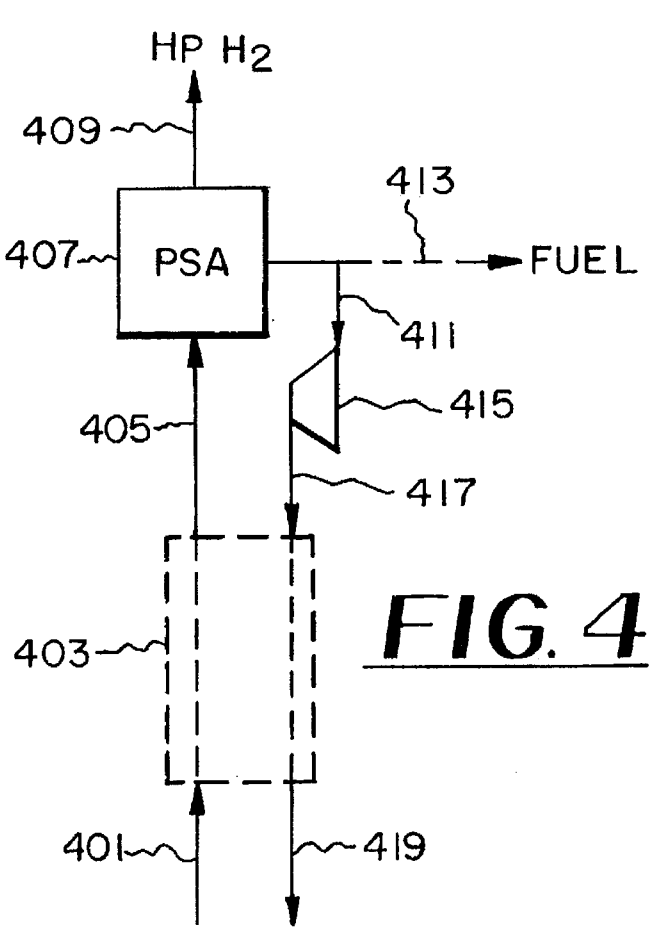
FIG. 4 is a schematic flow diagram for an embodiment of the present invention which utilizes a pressure swing adsorption process for hydrogen-olefin separation prior to final cryogenic separation.

Another alternative embodiment for separating hydrogen from uncondensed vapor from the warm condensing zone is shown in FIG. 4. Uncondensed first vapor 401 (equivalent to uncondensed first vapors 7 of FIG. 1 and 211 of FIG. 2), at a temperature between about −75° F. and −125° F. and a pressure of 150 to 650 psia, optionally is warmed in a similar manner in heat exchanger 403 against cooling stream 417 (later defined) to yield warmed stream 405. This warmed stream is further compressed if required (not shown) and introduced into pressure swing adsorption (PSA) system 407, in which the hydrocarbons are preferentially adsorbed to yield a nonadsorbed hydrogen-enriched product stream 409. Adsorbed hydrocarbons are desorbed to yield hydrocarbon-enriched PSA reject stream 411 at low pressure. Optionally, a portion of the desorbed gas is withdrawn as fuel 413.

PSA system 407 is a multiple-bed adsorption system which separates gas mixtures by selective adsorption using pressure swing for adsorption and desorption between higher and lower superatmospheric pressures, as is well known in the art. In some cases, the lower pressure can be subatmospheric, and this version of the process typically is defined as vacuum swing adsorption (VSA). In this specification, the term PSA includes any cyclic adsorption process which utilizes steps at superatmospheric or subatmospheric pressures. PSA system 407 produces a high purity hydrogen product 409 substantially free of the more strongly adsorbable hydrocarbon components and contains at least 98 vol % hydrogen at a pressure slightly below the pressure of feed 405. PSA reject stream 411 contains methane, ethane, ethylene, and higher hydrocarbons as well as some hydrogen typically lost in depressurization and purge steps. Reject stream 411, which typically contains about 35 vol % hydrogen at a pressure slightly above atmospheric, is compressed to 150 to 650 psia in compressor 415. Compressed stream 417 optionally is cooled in heat exchanger 430 against warming stream 401 to yield hydrocarbon-enriched stream 419 which provides feed 21 to second or cold condensing zone 23 of FIG. 1.

Figure 5:
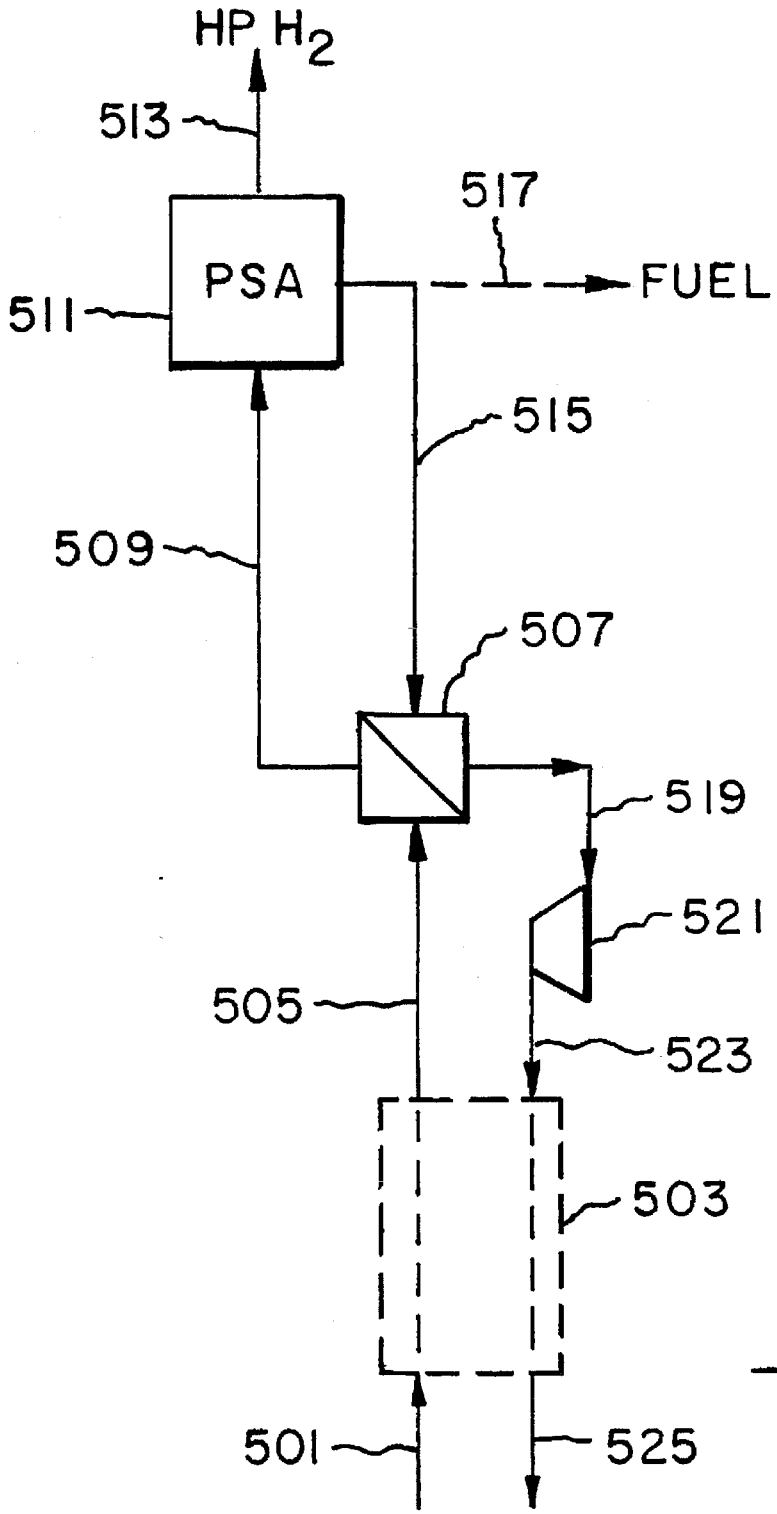
FIG. 5 is a schematic flow diagram for an embodiment of the present invention which utilizes a combination of a pressure swing adsorption process and a porous adsorptive membrane permeation process for hydrogen-olefin separation prior to final cryogenic separation

Another embodiment of the invention is illustrated in FIG. 5 in which the adsorbent membrane system of FIG. 3 is combined with the PSA system of FIG. 4. In this embodiment, uncondensed first vapor 501 (equivalent to uncondensed first vapor streams 7 of FIG. 1 and 211 of FIG. 2), at a temperature between about −75° F. and −125° F. and a pressure of 150 to 650 psia, optionally is warmed in a similar manner in heat exchanger 503 against cooling stream 523 (later defined) to yield warmed stream 505. This warmed stream is introduced into adsorbent membrane separator 507 which operates in a manner equivalent to adsorbent membrane separator 307 described above. Hydrogen-enriched nonpermeate 509 is further compressed if required (not shown) and introduced into PSA system 511 which operates in a manner equivalent to PSA system 407 of FIG. 4 in which the hydrocarbons are preferentially adsorbed to yield a nonadsorbed high purity hydrogen product stream 513. Adsorbed hydrocarbons are desorbed to yield hydrocarbon-enriched PSA reject stream 515 at low pressure. Optionally, a portion of the desorbed gas is withdrawn as fuel 517.

PSA reject stream 515 is introduced into the permeate side of adsorbent membrane separator 507 as a sweep gas which enhances the permeation of hydrocarbons through the adsorptive membrane. Combined sweep gas-permeate stream 519 is compressed to 150 to 650 psia in compressor 521 and compressed stream 523 optionally is cooled against warming stream 501 in heat exchanger 503 as described above. Hydrocarbon-enriched stream 525 provides feed 21 to second or cold condensing zone 23 of FIG. 1.

The alternative embodiment of FIG. 5 allows the recovery of essentially all of the ethylene in uncondensed first vapor 501 for return to the cold condensing zone, and in addition yields a high purity hydrogen product stream 513 containing greater than 98 vol % and as high as 99.9 vol % hydrogen at high pressure. This embodiment also reduces the energy consumption and capital cost of separating the ethylene and hydrogen.

The selection of a specific embodiment of the four discussed above for removing hydrogen and recovering ethylene will depend on several considerations. One of these is the source and composition of first vapor stream 7 from first or warm condensing zone 3 of FIG. 1. If feed gas 1 is a cracked gas obtained from the pyrolysis of ethane or propane, vapor stream 7 will contain as much as 50 to 80 vol % hydrogen, while if the feed gas is a cracked gas from naphtha pyrolysis the hydrogen content typically will be 25 to 50 vol % hydrogen. FCC or fluid coker offgas typically contains 10 to 40 vol % hydrogen. A second consideration is the requirement for the purity and pressure of the recovered hydrogen. If the hydrogen is used for fuel, the purity and pressure are not critical; if the hydrogen is used for hydrogenation within the ethylene plant or as export hydrogen product, high purity and preferably high pressure are required. A third consideration is the relative value of hydrogen and ethylene for a given plant location, which will determine the required recoveries of hydrogen and ethylene. These considerations are balanced against the operating characteristics of the four separation options described above to arrive at the optimum method for hydrogen and ethylene recovery.

In the separation of hydrogen-hydrocarbon mixtures described above, a polymeric membrane separator can provide a hydrogen purity of greater than 95 vol % if sufficient membrane surface area is used, but the hydrogen is produced at low pressure after permeation through the membrane. The adsorptive membrane separator typically produces lower purity hydrogen, but the hydrogen product is obtained at near feed pressure which is an advantage if the stream is work-expanded for recovery of refrigeration. A PSA system can produce very high purity hydrogen at near feed pressure, but can be more energy intensive and require more complicated equipment than either of the membrane-based separation methods. The combination of PSA and adsorptive membrane processes can produce high purity hydrogen with high hydrogen and ethylene recoveries. Ethylene recovery and hydrogen recovery generally are inversely related for all of these separation methods, but the actual relationship will differ depending on the selected method. Generally feed-streams with high hydrogen concentration are well-suited for PSA or adsorptive membrane systems because hydrogen, the major component, is recovered at near feed pressure while the hydrocarbons, which are minor components, permeate or adsorb and are recovered at low pressure. Feed-streams with lower hydrogen concentration may be better suited for polymeric membrane systems because hydrocarbons, the major components, are recovered at near feed pressure while hydrogen, the minor component, permeates and is recovered at low pressure.

The optimum method for hydrogen-hydrocarbon separation depends on a number of operating and economic factors, and therefore must be made on a case-by-case basis. Any of the methods described above, however, will reduce refrigeration requirements and equipment size in downstream processing equipment. In addition, each of these methods in combination with the use of a dephlegmator in the cold condensing zone reduces the potential for the formation and accumulation of unstable nitrogen compounds in the downstream olefin recovery system as earlier described.

EXAMPLE 1

A material and energy balance was carried out for the embodiment of FIG. 2 which uses a polymeric membrane for hydrogen-olefin separation. Feed gas 201 is a cracked gas feed at 490 psia which has been precooled to −33° F. utilizing several levels of propylene refrigerant, and condensed liquids have been removed for processing in a warm demethanizer column. The resulting −33° F. feed gas 201 at a flow rate of 8120 lb moles per hour contains about 24 mole % hydrogen, 38 mole % methane, 31 mole % ethylene, and 7 mole % ethane and heavier hydrocarbons. The feed gas is cooled to −112° F. in dephlegmator 204 in warm condensing zone 203 utilizing two levels of ethylene refrigerant. Condensed prefractionated first liquid stream 205 at −47° F. is sent to the warm demethanizer column. The −112° F. first vapor stream 211, at a flow rate of 5167 lb moles per hour containing about 37.5 mole % hydrogen, 51 mole % methane, 11 mole % ethylene and less than 0.5 mole % ethane, is warmed in heat exchanger 213 to near ambient temperature.

The warmed vapor stream 214 is processed in polymeric membrane separator 215 to produce hydrogen product permeate stream 217 at 1317 lb moles per hour containing 90 mole % hydrogen and 10 mole % methane at a pressure of about 50 to 100 psia. Non-permeate gas stream 219, at 3850 lb moles per hour containing about 19.5 mole % hydrogen, 65.5 mole % methane, 14.5 mole % ethylene and less than 0.5 mole ethane at a pressure slightly below that of vapor stream 214, is cooled in heat exchanger 213 to near its dew point of −99° F. Cooled stream 235 is further cooled to −158° F. in dephlegmator 243 of cold condensing zone 241 to condense and prefractionate the remaining ethylene and ethane. Ethylene-rich second liquid 247 is sent to a cold demethanizer column for further fractionation (not shown). In this Example, compressor 225, second membrane separator 227, and expander 237 are not used.

Cold light gas stream 253 at 2842 lb moles per hour contains about 26.5 mole hydrogen, 73.5 mole methane and less than 0.2 mole ethylene. 99.8% of the ethylene in the feed gas 201 is recovered in the two liquid streams 205 and 247, and only 0.2% is lost in cold light gas stream 253. Cold light gas stream 253 is combined with the light gas stream from the overhead of the cold demethanizer column (not shown) and work expanded to provide all of the refrigeration required for dephlegmator heat exchanger 243. In this example, about 60% of the hydrogen in feed gas 201 is recovered as product stream 217 from polymeric membrane separator 215.

EXAMPLE 2

In another embodiment of the invention, warmed vapor stream 214 is processed in polymeric membrane separator 215 to produce the same hydrogen product permeate stream 217 of Example 1 at 1317 lb moles per hour containing 90 mole % hydrogen and 10 mole % methane. Nonpermeate 219 is introduced into another polymeric membrane separator (not shown) and another permeate hydrogen stream at 735 lb moles per hour also containing 90 mole % hydrogen and 10 mole % methane is withdrawn for fuel. The nonpermeate gas stream 223 at 3115 lb moles per hour contains about 3 mole % hydrogen, 78.5 mole % methane, 18 mole % ethylene and less than 0.5 mole % ethane, and is cooled in heat exchanger 213 to near its dew point of −88° F. to yield stream 235. This stream (as stream 239) is cooled to −141 ° F. in dephlegmator 243 of cold condensing zone 241 to condense and prefractionate the remaining ethylene and ethane. Compressor 225, membrane separator 227, and expander 237 are not used in this Example.

Cold overhead gas stream 253 is withdrawn at 1835 lb moles per hour containing about 5 mole % hydrogen, 94.5 mole % methane and less than 0.3 mole % ethylene. Again, 99.8% of the ethylene in the feed gas 201 is recovered in the two liquid streams 205 and 247. As in Example 1, cold light gas stream 253 is combined with the light gas stream from the top of the cold demethanizer column and work expanded to provide all of the refrigeration required for dephlegmator 243. In this Example, about 60% of the hydrogen in the feed gas is recovered as product stream 217 from the polymeric membrane separator 215 and an additional 35% is rejected to the fuel system in the permeate from the second membrane separator (not shown).

In these two Examples, dephlegmators are used in both warm and cold condensing zones 203 and 241 to provide two prefractionated liquid feed streams 205 and 247 to two demethanizer columns (not shown) which are not part of the present invention. Any of the hydrogen removal process embodiments of the present invention can be used effectively in other types of ethylene recovery processes, such as those which use the conventional partial condensation and single demethanizer process, or the single dephlegmator, single demethanizer process described in U.S. Pat. No. 4,002,042. The present invention can be retrofitted into existing plants utilizing any of these types of cryogenic separation processes and is equally suitable for use in new plants. A mixed refrigerant cycle could be used in place of the conventional ethylene refrigerant cycle to provide refrigeration in the warm and cold feed condensing zones.

One or more partial condensers could be utilized in series in both warm feed condensing zone 203 and cold feed condensing zone 241, or a combination of partial condensers and dephlegmators could be used in either or both feed condensing zones. Preferably, cold feed condensing zone 241 uses a dephlegmator in order to minimize the amount of methane which is condensed and sent to the demethanizer column(s) and to permit the condensation of ethylene at warmer temperatures than would be possible using a partial condenser. In addition, as earlier described, operating a dephlegmator in cold condensing zone 241 above about −166° F. and preferably above about −160° F. minimizes or eliminates the formation and accumulation of unstable nitrogen compounds in the ethylene recovery system. The use of dephlegmators in place of partial condensers provides refrigeration energy savings in addition to the energy savings obtained by removing the bulk of the hydrogen from the cold feed gas.

This process can also be used in other types of ethylene recovery units, for example, for the recovery of ethylene and/or propylene from refinery gases such as fluid catalytic cracking (FCC) offgas and fluid coker offgas, which are known to be primary sources of NO. In these units, a hydrogen product stream may not be required and a large fraction of the hydrogen in the refinery gas can be rejected to fuel using the appropriate hydrogen removal system.

A preferred mode of the invention is that at least 50% and preferably more than 75% of the ethylene in feed gas 1 (FIG. 1) is condensed and recovered in warm feed condensing zone 3 prior to hydrogen removal in hydrogen-olefin separation system 13. This minimizes the amount of feed gas which is processed in the hydrogen removal system and also minimizes the amount of ethylene which is lost with the hydrogen in the hydrogen removal system. When feed gas 1 is obtained by precooling a typical ethylene plant cracked gas, warm feed condensing zone 3 should operate at temperatures between about −75° F. and −125° F. In a second preferred mode of the invention, at least 50% of the hydrogen in feed gas 1 is removed in hydrogen-olefin separation system 13 such that the remaining ethylene can be condensed in cold feed condensing zone 23 at significantly warmer temperature levels, i.e. at least 15° F. warmer than the temperature required in cold feed condensing zone 23 without hydrogen removal in hydrogen-olefin separation system 13.

In the hydrogen removal process describd in earlier-cited U.S. Pat. No. 5,082,481, all of the cracked gas is processed in one or more conventional membrane systems prior to removal of water, $CO_2$ and heavy ($C_5$+) hydrocarbons and prior to cooling of the cracked gas. Therefore, the quantity of feed gas processed in the membranes is very large and the concentration of ethylene in the gas processed in the membranes is very high. This results in very large membrane areas and very high ethylene losses in the hydrogen permeate streams which must then be recovered and recycled back into the feed gas. In the example cited, the ratio of ethylene to hydrogen in the feed gas processed in the first membrane is 1.2 to 1. Removing only 20% of the hydrogen results in a loss of 1.3% of the ethylene, which is then recovered in a second membrane and recycled back into the feed gas. With typical conventional membranes, the hydrogen removed via the membrane will also contain some water and $CO_2$, which may be detrimental for some uses of the hydrogen stream. The $C_5$+ hydrocarbons can also be detrimental to the operation of both membrane and PSA systems.

In Example 1 above, in which about 60% of the hydrogen is removed after cooling the feed gas to −112° F. to condense 80% of the ethylene, the quantity of feed gas which is processed in polymeric membrane separator 215 is reduced by more than 50% as compared to the process of U.S. Pat. No. 5,082,481. The amount of ethylene in the feed gas which is processed in the membrane system of the present invention is reduced by 80% and the ratio of ethylene to hydrogen in the feed gas processed in the membrane system is reduced to only 0.3 to 1, resulting in very small ethylene losses in the membrane system. In addition, the quantity of light gases available for work expansion is increased by 60% and the quantity of low level refrigeration required in cold feed condensing zone 241 is reduced by 11% as compared to the same process without hydrogen removal. As a result, the amount of low level refrigeration which can be produced exceeds that required in cold feed condensing zone 241. This excess low level refrigeration can be used to subcool high pressure ethylene or other refrigerant liquid and/or to provide refrigeration for the demethanizer column condenser. The amount of −150° F. ethylene refrigeration required is reduced accordingly, resulting in a savings of 10% in refrigeration compression power for low level refrigeration. Some of this excess low level refrigeration could also be utilized to further cool the feed gas to increase ethylene recovery in the cold feed condensing zone or to provide refrigeration below −150° F. in the demethanizer column to reduce ethylene losses in the overhead vapor from that column.

In Example 2 above, in which about 95% of the hydrogen is removed after cooling the feed gas to −112° F., the quantity of light gases available for work expansion is increased by 32% as compared to the same process without hydrogen removal. However, this provides a savings of 12% in refrigeration compression power for low level refrigeration because the quantity of low level refrigeration required in cold feed condensing zone 241 is reduced by more than 25%.

Using the two dephlegmator feed cooling arrangement of FIG. 2 and Examples 1 and 2, but without the use of polymeric membrane separator 215 for removal of hydrogen, requires that vapor 211 be cooled to −174° F. in cold condensing zone 241 to achieve the same 99.8% ethylene recovery. Using a low temperature hydrogen recovery system (not shown) to upgrade 60% of the hydrogen in cold light gas 253 from cold dephlegmator 243 to a 90 mole % purity hydrogen product reduces the available expander gas flow by 40% as compared to Example 1. This requires the use of −150° F. ethylene refrigeration in cold dephlegmator 243 to obtain the same 99.8% ethylene recovery. Ethylene recovery is limited to 99.8% with this arrangement by the constraints imposed by the use of a low temperature hydrogen recovery system and by the required fuel gas pressure, which limit the amount of low level expander refrigeration which can be produced.

The process of the present invention requires a much smaller hydrogen removal system and results in a much lower ethylene loss than the process of U.S. Pat. No. 5,082,481. The present invention also permits complete elimination of the low temperature hydrogen recovery equipment and yields higher ethylene recoveries. With this process, hydrogen is removed after all water, $CO_2$, $C_5$+ hydrocarbons and other trace impurities have been removed from the feed gas, providing a better quality hydrogen stream than with the process of U.S. Pat. No. 5,082,481 and eliminating all components which may be detrimental to the hydrogen removal system.

Elimination of the low temperature hydrogen recovery system also eliminates the low pressure methane vaporization circuit(s) of the hydrogen recovery heat exchangers where there is a potential for accumulation of unstable nitrogen compounds. The use of a dephlegmator in cold feed condensing zone 241 in place of a partial condenser eliminates the circuits which rewarm the coldest liquid feeds to the demethanizer column in which there also is potential for accumulation of unstable nitrogen compounds. This provides a process in which no liquid streams are produced at temperatures below −166° F. (−110° C.), which is believed to be the critical upper temperature limit for such accumulation.

In a preferred operating mode of the process of the present invention as described in FIG. 1, feed gas 1 is cooled sufficiently in warm feed condensing zone 3 to condense at least 50% of the ethylene in feed gas 1, preferably more than 75%, before hydrogen is removed. This is desirable in order to minimize the amount of feed gas 11 which is processed in hydrogen removal system 13, which in turn reduces the size of the system and minimizes the amount of ethylene lost with hydrogen product gas 15.

In a second preferred operating mode of the process of this invention, at least 50% of the hydrogen in the feed gas is removed prior to cold feed condensing zone 23 such that the remaining ethylene can be condensed at significantly higher temperature levels than if no hydrogen were removed from the feed gas. In the two Examples above, the dephlegmator overhead temperature in cold feed condensing zone 23 is increased by 16° F. and 33° F. by the removal of 60% and 95%, respectively, of the hydrogen prior to final cooling in cold condensing zone 23. This provides the 10 to 12% reduction in refrigeration compression power for low level refrigeration which was achieved in the Examples above. This also permits elimination of the low temperature hydrogen recovery system earlier described and eliminates the low pressure methane vaporization circuit(s) of the hydrogen recovery heat exchangers which are known to be susceptible to accumulation of unstable nitrogen compounds.

In a third preferred operating mode of the invention, at least the last step of feed cooling in cold feed condensing zone 23 is accomplished by a dephlegmator. The dephlegmator is preferred 1) to minimize the amount of methane which is condensed and sent to the demethanizer column(s), 2) to permit condensation of ethylene at still warmer temperatures, and 3) to eliminate the much colder liquid stream produced in a partial condenser-type heat exchanger which is also known to be susceptible to accumulation of unstable nitrogen compounds.

The combination of these three preferred modes of operation provides maximum energy efficiency at reasonable capital cost and also provides potential safety advantages by eliminating the very cold liquid streams which promote accumulation of unstable nitrogen compounds in conventional ethylene recovery units. Condensing at least 50% of the ethylene in the feed gas before hydrogen is removed reduces the size of the hydrogen removal system and minimizes the amount of ethylene which is lost. Utilizing a dephlegmator for the last step of feed cooling after removal of at least 50% of the hydrogen raises the coldest feed temperature in the cold feed condensing zone by 30° F. to 60° F. or more compared with a process using a partial condenser-type heat exchanger without removal of hydrogen.

The essential characteristics of the present invention are described completely in the foregoing disclosure. One skilled in the art can understand the invention and make various modifications without departing from the basic spirit of the invention, and without deviating from the scope and equivalents of the claims which follow.

We claim:

1. A method for the recovery of olefins from a feed gas containing olefins and hydrogen which comprises cooling and partially condensing the feed gas in a first condensing zone to yield a first vapor enriched in hydrogen and a first liquid enriched in olefins, introducing the first vapor into a hydrogen-olefin separation process and withdrawing therefrom a hydrogen-enriched stream and an olefin-enriched intermediate stream, introducing the olefin-enriched intermediate stream into a second condensing zone wherein the olefin-enriched intermediate stream is further cooled, partially condensed, and rectified in a dephlegmator, and withdrawing from the dephlegmator a second liquid further enriched in olefins and a second vapor depleted in olefins.

2. The method of claim 1 wherein the feed gas contains nitric oxide and the temperature at any point in the second condensing zone is maintained above about −166° F.

3. The method of claim 1 wherein the feed gas comprises cracked gas from the pyrolysis of hydrocarbons in the presence of steam, fluid catalytic cracking offgas, or fluid coker offgas.

4. The method of claim 1 wherein the hydrogen-olefin separation process comprises a polymeric membrane permeation process in which the first vapor is separated into a hydrogen-enriched permeate and an olefin-enriched nonpermeate which provides the olefin-enriched intermediate stream to the second condensing zone.

5. The method of claim 4 wherein the polymeric membrane permeation process comprises two polymeric membrane permeator stages in series in which the first vapor is introduced into a first polymeric membrane permeator stage, a first hydrogen-enriched permeate stream and a first olefin-enriched nonpermeate stream are withdrawn therefrom, the first olefin-enriched nonpermeate stream provides the olefin-enriched intermediate stream to the second condensing zone, the first hydrogen-enriched permeate stream is introduced into a second polymeric membrane permeator stage, and a second hydrogen-enriched permeate stream and a second olefin-enriched nonpermeate stream are withdrawn therefrom.

6. The method of claim 5 which further comprises combining some or all of the second olefin-enriched nonpermeate stream from the second polymeric membrane permeator stage with the first olefin-enriched nonpermeate stream from the first polymeric membrane permeator stage.

7. The method of claim 1 wherein the hydrogen-olefin separation process comprises a porous adsorptive membrane permeation process in which the first vapor is separated into a hydrogen-enriched nonpermeate and an olefin-enriched permeate which provides the olefin-enriched intermediate stream to the second condensing zone.

8. The method of claim 7 wherein the porous adsorptive membrane permeation process comprises two adsorptive membrane permeator stages in series in which the first vapor is introduced into a first adsorptive membrane permeator stage, a first hydrogen-enriched nonpermeate stream and a first olefin-enriched permeate stream are withdrawn therefrom, the first olefin-enriched permeate stream provides the olefin-enriched intermediate stream to the second condensing zone, the first hydrogen-enriched nonpermeate stream is introduced into a second adsorptive membrane permeator stage, and a further hydrogen-enriched nonpermeate stream and an additional olefin-enriched permeate stream are withdrawn therefrom.

9. The method of claim 8 which further comprises combining some or all of the additional olefin-enriched permeate stream from the second adsorptive membrane permeator stage with the first olefin-enriched permeate stream from the first adsorptive membrane permeator stage.

10. The method of claim 1 wherein the hydrogen-olefin separation process comprises a pressure swing adsorption process in which the first vapor is separated into a hydrogen-enriched nonadsorbed product gas and an olefin-enriched desorbed product gas which provides the olefin-enriched intermediate stream to the second condensing zone.

11. The method of claim 1 wherein the hydrogen-olefin separation process comprises introducing the first vapor into the feed side of a membrane separation zone containing an adsorptive membrane which divides the zone into the feed side and a permeate side, withdrawing a hydrogen-enriched nonpermeate therefrom, introducing the hydrogen-enriched nonpermeate into a pressure swing adsorption process and withdrawing therefrom a nonadsorbed product gas further enriched in hydrogen and an olefin-enriched desorbed gas, sweeping the permeate side of the membrane separation zone with the olefin-enriched desorbed gas and withdrawing therefrom a combined olefin-enriched permeate-sweep gas mixture which provides the olefin-enriched intermediate stream to the second condensing zone.

12. The method of claim 1 wherein the first vapor is warmed prior to introduction into the hydrogen-olefin separation process.

13. The method of claim 1 wherein the olefin-enriched intermediate stream is cooled prior to introduction into the second condensing zone.

14. The method of claim 13 wherein cooling of the olefin-enriched intermediate stream is achieved at least in part by indirect heat exchange with the first vapor from the first condensing zone.

15. The method of claim 13 wherein cooling of the olefin-enriched intermediate stream is achieved at least in part by work expansion prior to the second condensing zone.

16. The method of claim 1 wherein the first condensing zone comprises a partial condenser.

17. The method of claim 1 wherein the first condensing zone comprises a dephlegmator.

18. The method of claim 1 wherein the olefins comprise at least ethylene.

19. The method of claim 1 wherein the feed gas is cooled in the first condensing zone to condense at least 50% of the ethylene in the feed gas before hydrogen is removed.

20. The method of claim 1 wherein the feed gas is cooled in the first condensing zone to condense at least 75% of the ethylene in the feed gas before hydrogen is removed.

21. The method of claim 1 wherein at least 50% of the hydrogen in the feed gas is removed in the hydrogen-olefin separation process.

22. The method of claim 1 wherein at least 75% of the hydrogen in the feed gas is removed in the hydrogen-olefin separation process.

* * * * *